US009057156B2

(12) United States Patent
Reid et al.

(10) Patent No.: US 9,057,156 B2
(45) Date of Patent: Jun. 16, 2015

(54) PROCESS FOR IMPROVING CHLORINE DIOXIDE BLEACHING OF PULP

(75) Inventors: Douglas W. Reid, Marietta, GA (US); John Atwood, Augusta, GA (US); Scott Carmichael, Marietta, GA (US); Daniel Connell, Canton, GA (US)

(73) Assignee: SKZO NOBEL CHEMICALS INTERNATIONAL B.V., Amersfoort (NL)

( * ) Notice: Subject to any disclaimer, the term of this patent is extended or adjusted under 35 U.S.C. 154(b) by 0 days.

(21) Appl. No.: 13/996,597

(22) PCT Filed: Dec. 19, 2011

(86) PCT No.: PCT/EP2011/073265

§ 371 (c)(1),
(2), (4) Date: Jun. 21, 2013

(87) PCT Pub. No.: WO2012/084842

PCT Pub. Date: Jun. 28, 2012

(65) Prior Publication Data

US 2013/0269891 A1 Oct. 17, 2013

Related U.S. Application Data

(60) Provisional application No. 61/426,179, filed on Dec. 22, 2010.

(51) Int. Cl.
*D21C 9/14* (2006.01)
*D21C 9/10* (2006.01)

(52) U.S. Cl.
CPC ..... *D21C 9/144* (2013.01); *D21C 9/1036* (2013.01); *D21C 9/14* (2013.01); *D21C 9/142* (2013.01)

(58) Field of Classification Search
CPC ..... D21C 9/1036; D21C 9/14; D21C 9/142; D21C 9/144; D21C 9/12; Y10S 162/08
USPC ..... 162/87–88, 73, 74, 76, DIG. 8
See application file for complete search history.

(56) References Cited

U.S. PATENT DOCUMENTS

| | | | | |
|---|---|---|---|---|
| 3,020,197 | A * | 2/1962 | Schuber | 162/78 |
| 3,802,958 | A | 4/1974 | Croon et al. | |
| RE28,884 | E | 6/1976 | Jack et al. | |
| RE28,887 | E | 6/1976 | Jack et al. | |
| 4,013,506 | A | 3/1977 | Histed et al. | |
| 4,238,281 | A | 12/1980 | Histed | |
| 4,657,633 | A | 4/1987 | Dwiggins | |
| 4,740,212 | A | 4/1988 | Yant et al. | |
| 5,073,301 | A * | 12/1991 | Suess et al. | 252/402 |
| 5,268,075 | A * | 12/1993 | Chang et al. | 162/89 |
| 5,792,316 | A | 8/1998 | Tsai | |
| 2003/0155086 | A1 * | 8/2003 | Sjoblom et al. | 162/6 |
| 2005/0045291 | A1 | 3/2005 | Ragnar et al. | |
| 2007/0079944 | A1 | 4/2007 | Amidon et al. | |
| 2008/0023668 | A1 * | 1/2008 | Callerame | 252/182.11 |
| 2013/0269891 | A1 * | 10/2013 | Reid et al. | 162/88 |

FOREIGN PATENT DOCUMENTS

| | | | |
|---|---|---|---|
| GB | 2 248 075 | A | 3/1992 |
| JP | 50029802 | A * | 3/1975 |
| JP | 2000220088 | A * | 8/2000 |
| WO | WO 87/03313 | A1 | 6/1987 |
| WO | WO 88/01661 | A1 | 3/1988 |
| WO | WO 91/05910 | A1 | 5/1991 |
| WO | WO 2006/119392 | A1 | 11/2006 |
| WO | WO 2008/152189 | A2 | 12/2008 |
| WO | WO 2012084842 | A1 * | 6/2012 |

OTHER PUBLICATIONS

International Search Report and Written Opinion dated Jun. 12, 2012 for related PCT Application No. PCT/EP2011/073265.

Abstract of Li et al., "Application of vanadium pentoxide to chlorine dioxide bleaching of soda-AQ wheat straw pulp," Conference proceedings (2006).

Abstract of Adorjan et al., Influence of carbonyl groups on the brightness reversion of *Eucalyptus* kraft pulp, Conference Proceedings (2006), pp. 134-137.

Abstract of Leroy et al., "Extended oxygen delignification, Part 2:multi-stage oxygen bleaching with intermediate hypochlorous acid stages," Appita, vol. 57, (2004) pp. 224-227.

Abstract of Hurst et al., "High-Brightness Pulp Bleaching With Monox-L," Pulp Pap. Can., vol. 93, No. 11, Nov. 1992, pp. 41-44.

Abstract of Nay, MJ, "Statistical Quality Control in the Bleach Plant," Conference proceedings (1991), pp. 213-231.

Abstract of Reeve, DW, "Chlorine Dioxide Brightening," Conference proceedings (1990), pp. 149-157.

Abstract of Mullinder, J., "High Brightness Bleaching Agent Comes Through Finnish Mill Trials," Pulp Pap. J., vol. 41, No. 7, Jul.-Aug. 1988, p. 35.

Allan et al., "Selective Adsorption: A New Approach to Cellulose Protection . . . or Hydrogen Peroxide," Int'l BI Conf (2000) 13 pages.

* cited by examiner

*Primary Examiner* — Jose Fortuna

(74) *Attorney, Agent, or Firm* — Alice C. Su

(57) ABSTRACT

The invention is directed to a method for increasing brightness of pulp, wherein the method includes: contacting a pulp slurry with chlorine dioxide in a final D ($ClO_2$) bleaching stage; and adding a brightening additive to the final D bleaching stage after at least a portion of the chlorine dioxide has been consumed, in an amount sufficient to increase brightness of the pulp; wherein the brightening additive is an inorganic compound chosen from hypochlorous acid, one or more precursor compounds that form hypochlorous acid in said final D bleaching stage, or a mixture thereof.

20 Claims, 19 Drawing Sheets

Impact of Different Addition Points

Impact of Different Addition Points and pH

Impact of Different Additives and Amounts

Total Retention Time = 3 hrs
ClO2 = 6 kg/t as ClO2.
Additive = 5.26 kg/t (as aCl) Additive = NaOCl unless otherwise specified.

Impact of Different Addition Point on Final pH

Impact of Different Amounts of Additive on Brightness

Additive = NaOCl
Additive added 3 min before end of stage Total retention time = 3 hrs

Impact of Different Amounts of Additive on Brightness

Impact of Different Amount of Additive on Residuals

Impact of Different Amount of Additive on Residuals

Impact of Different Amount of Additive on Residuals

Impact of Different Amount of Additive on Residuals

Additive = NaOCl
Additive added 3 min before end of stage Total Retention Time = 3 hrs Impact of Additive on Brightness Reversion Additive = NaOCl
Additive added 3 min before end of stage Total Retention Time = 3 hrs Impact of Additive on Brightness Reversion Impact of Different Amountsof Additive on Reverted Brightness Additive = NaOCl
Additive added 3 min before end of stage Total Retention Time = 3 hrs

Impact of Different Amounts of Additive on Reverted Brightness

Impact of Additive on Viscosity

Additive = NaOCl
Additive added 3 min before end of stage Total Retention Time = 3 hrs Impact of Additive on Viscosity Additive = NaOCl
Additive added 3 min before end of Total Retention Time = 3 hrs

Impact of Residuals on Viscosity

Impact of Additive and Residuals on Viscosity

Additive - NaOCl
Additive added 3 min before end of stage Total Retention Time = 3 hrs

Impact of Different Additive and Residuals on Viscosity

PROCESS FOR IMPROVING CHLORINE DIOXIDE BLEACHING OF PULP

This application is a national stage filing under 35 U.S.C. §371 of PCT/EP2011/073265, filed Dec. 19, 2011, which claims priority to U.S. Provisional Application No. 61/426,179, filed on Dec. 22, 2010, the contents of which are incorporated herein by reference in their entirety.

FIELD OF THE INVENTION

The field of the invention relates to paper pulp bleaching. More particularly, it refers to increasing brightness of pulp in the final chlorine dioxide bleaching stage of a pulp mill bleach plant.

BACKGROUND OF THE INVENTION

Pulp mills are usually operated to bleach the pulp to the highest possible brightness. This may allow the mill to obtain a higher price on the market or reduce costs in the papermaking process by reducing the amount of expensive additives used when making the paper, such as optical brightening agents. In practice, however, it can be difficult to consistently maintain very high brightness from the bleach plant.

Problems with obtaining and maintaining high brightness can be a result of the chemistry used in typical bleaching operations, as well as limitations resulting from design or equipment limitations. In that regard, it is common for $ClO_2$ bleaching to stall out in later bleaching stages, e.g., the final D2 bleaching stage, where brightness no longer increases and can even decrease as the pulp is retained longer in the bleaching stage. This requires the pH to be closely controlled in order for the the brightness to be maximized for the $ClO_2$ bleaching, which can be difficult due to very long dead time and process variation.

Also, it is common for older pulp mills to run at higher production rates than the rates they were originally designed for. In such a case, retention time in the bleaching process is lower than optimal, resulting in high residual $ClO_2$ and relatively low brightness.

Accordingly, there exists a need to increase brightness of the pulp, while avoiding the problems discussed above.

SUMMARY OF THE INVENTION

It has been found that increased pulp brightness can be achieved beyond standard bleaching practices, while avoiding the above mentioned problems, by a process that involves modifying the final D ($ClO_2$ bleaching) stage. This process can also be used to make the bleaching process less pH dependent, so it can produce pulp of more consistent brightness.

It has been discovered that by adding certain additives partway through the final D ($ClO_2$ bleaching) stage, pulp brightness from the stage can be increased. In one embodiment, the additive is an inorganic compound selected from hypochlorous acid or compounds that form hypochlorous acid. Thus, in one embodiment, the hypochlorous acid is added to the final D2 bleaching stage in the form of Cl, Cl water, sodium hypochlorite, or mixtures of these.

In one embodiment, the additive is added to the D2 stage partway through the stage, i.e., after at least a portion the $ClO_2$ has been consumed, in an amount sufficient to increase the brightness of the pulp compared to a final D2 stage without the additive. In an embodiment, the additive is added after about 60% of the D2 stage has been completed, for example, after 2 hours of a 3 hour stage. In another embodiment, the additive is added close to the end of the D2 bleaching stage. In embodiments, the additive is added with less than about 5 minutes remaining, or with less than about 4 minutes remaining or with less than about 3 minutes remaining in the D2 stage. In one embodiment, where the D2 stage has limited retention time, e.g., about 30 minutes, the additive can be added near the end of the stage, as discussed above. In one embodiment, the process is carried out in a D2 stage that follows a D1 bleaching stage with no intermediate extraction stage. In one embodiment, the pulp is a soft wood pulp, e.g., a typical SW pulp from a southern U.S. mill.

Additional objects, advantages and novel features will be apparent to those skilled in the art upon examination of the description that follows.

FIGS. **4*a*-4*d*** illustrate the effect of additive addition time on residual species present.

Figure 5:
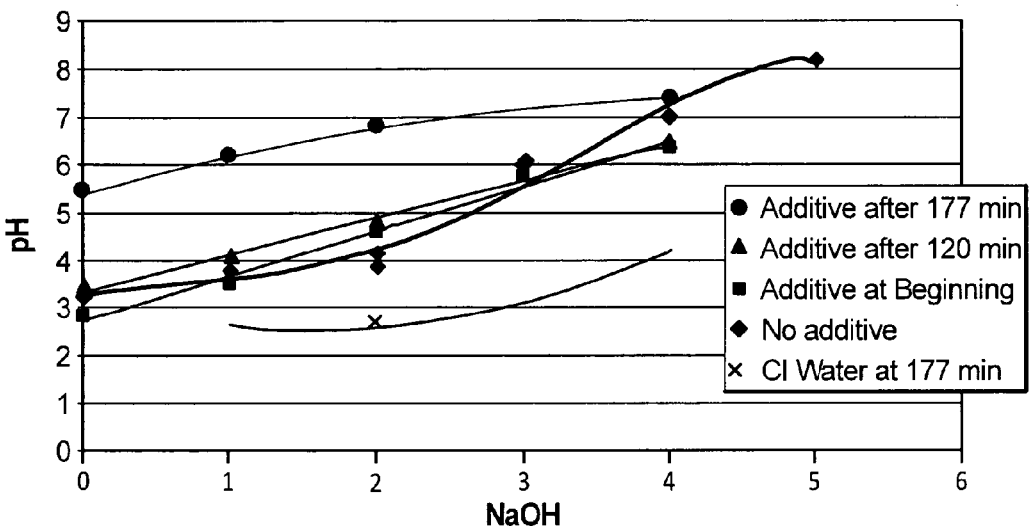

FIG. 5 illustrates the impact of the addition point of the bleaching additive on final pH.

Figure 6:
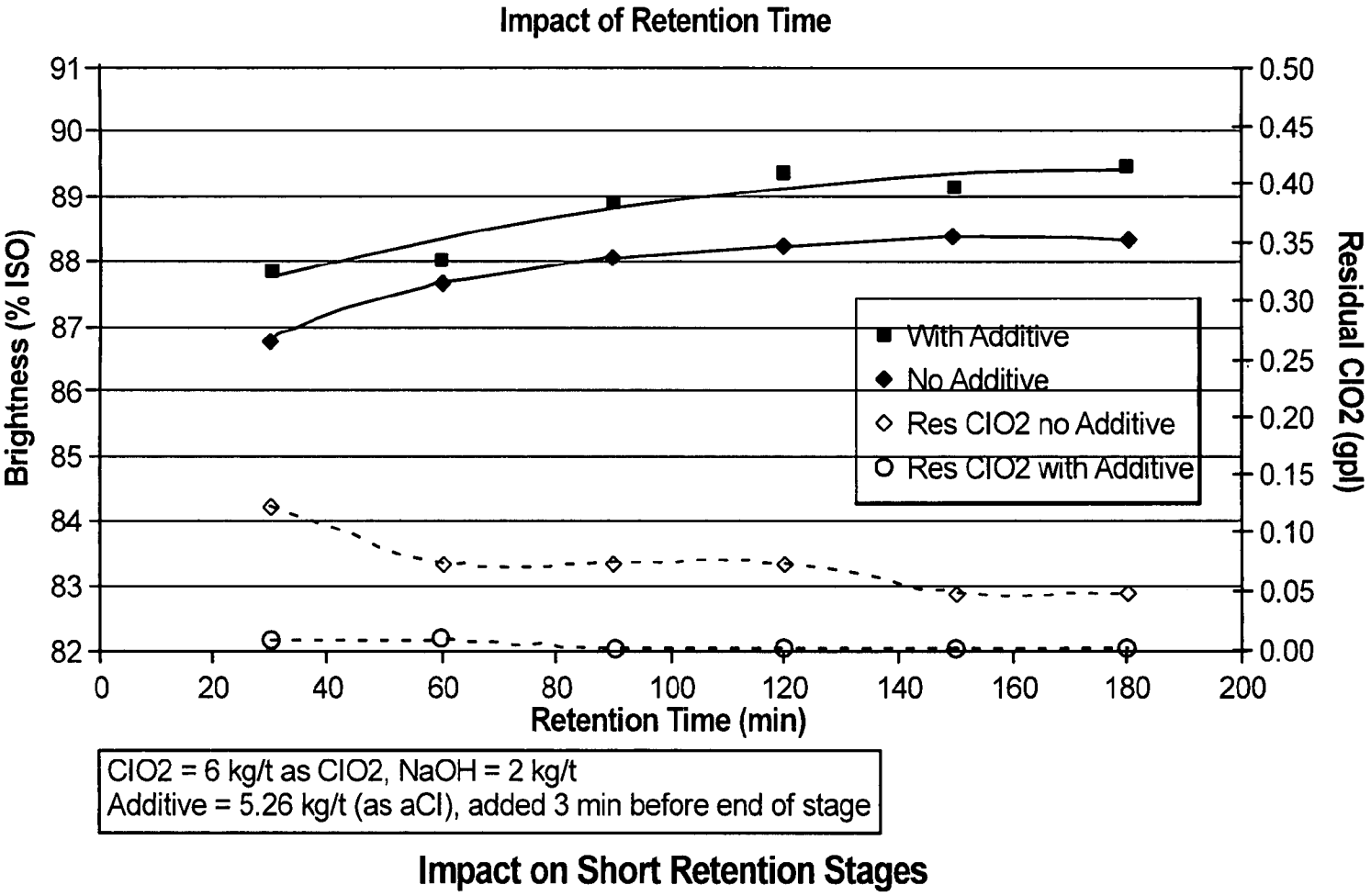

FIG. 6 illustrates the effect of the additive on brightness as a function of retention time.

Figure 7:
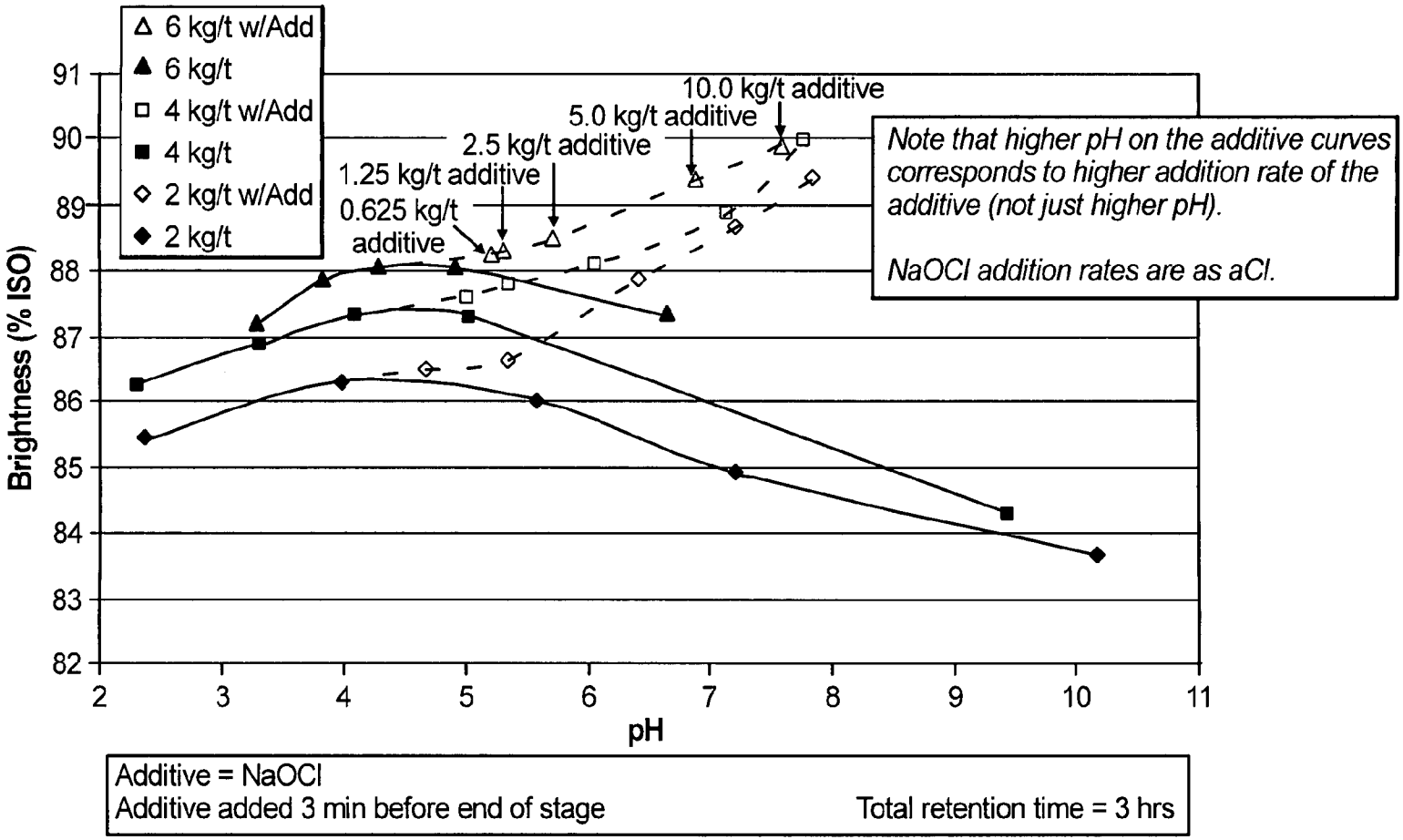
Figure 8:
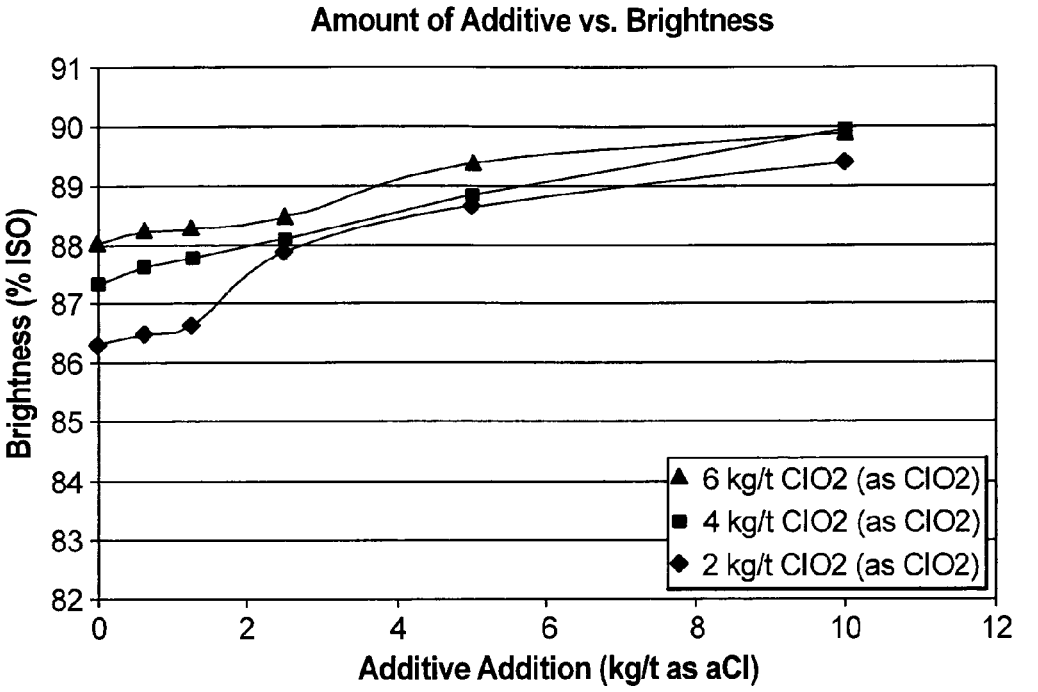
Figure 9A:
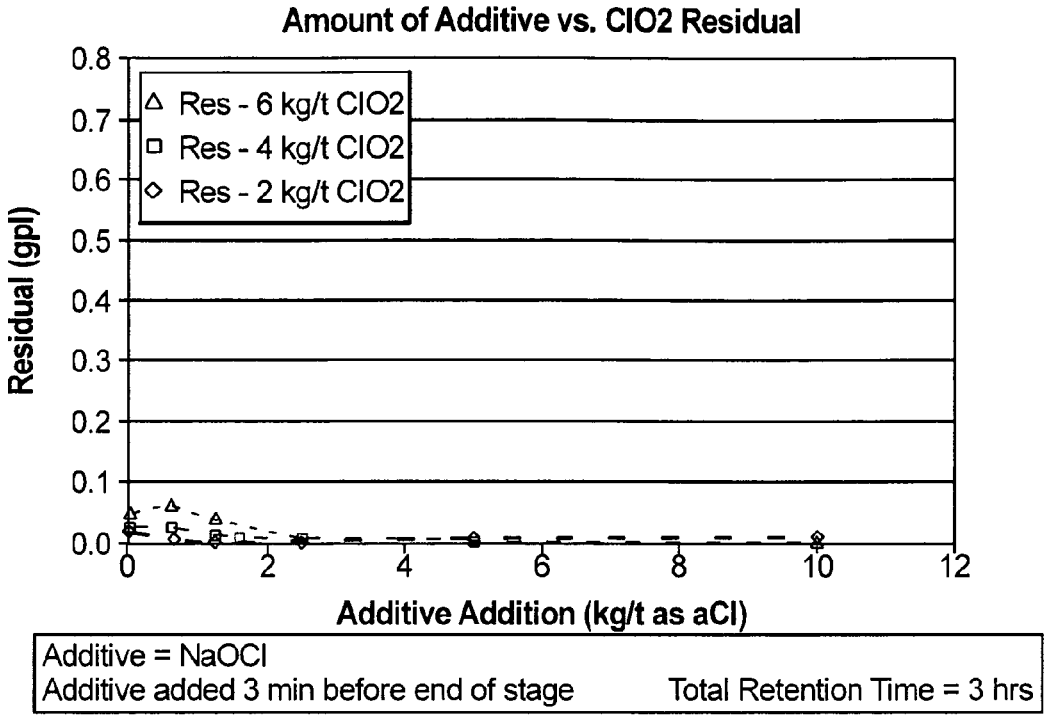
Figure 9B:
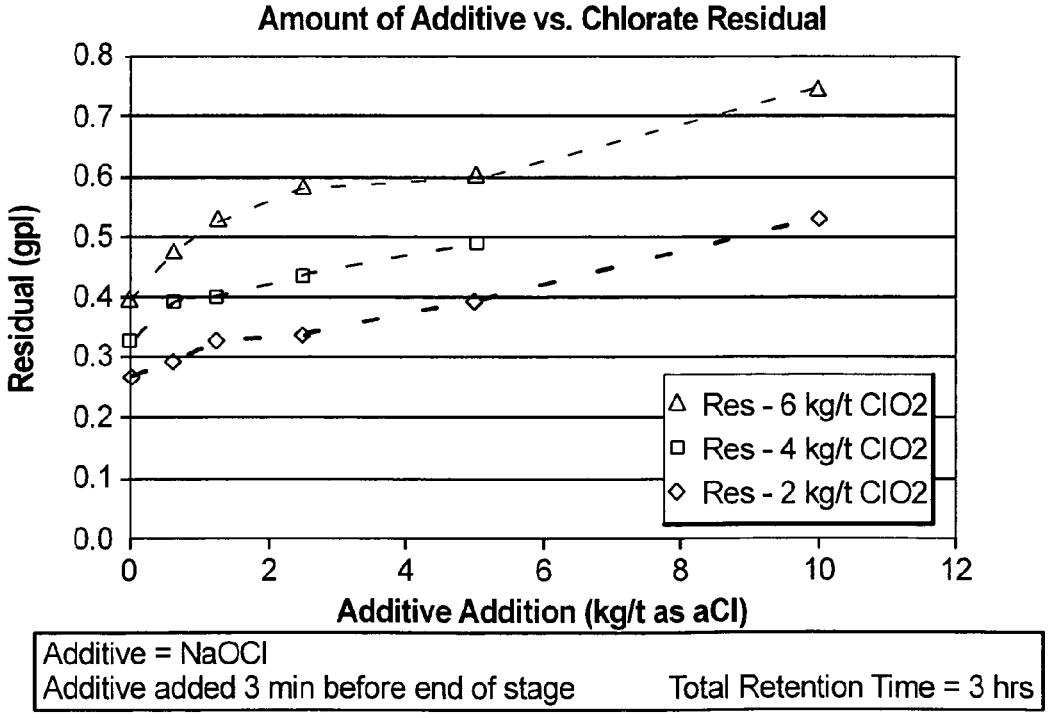
Figure 9C:
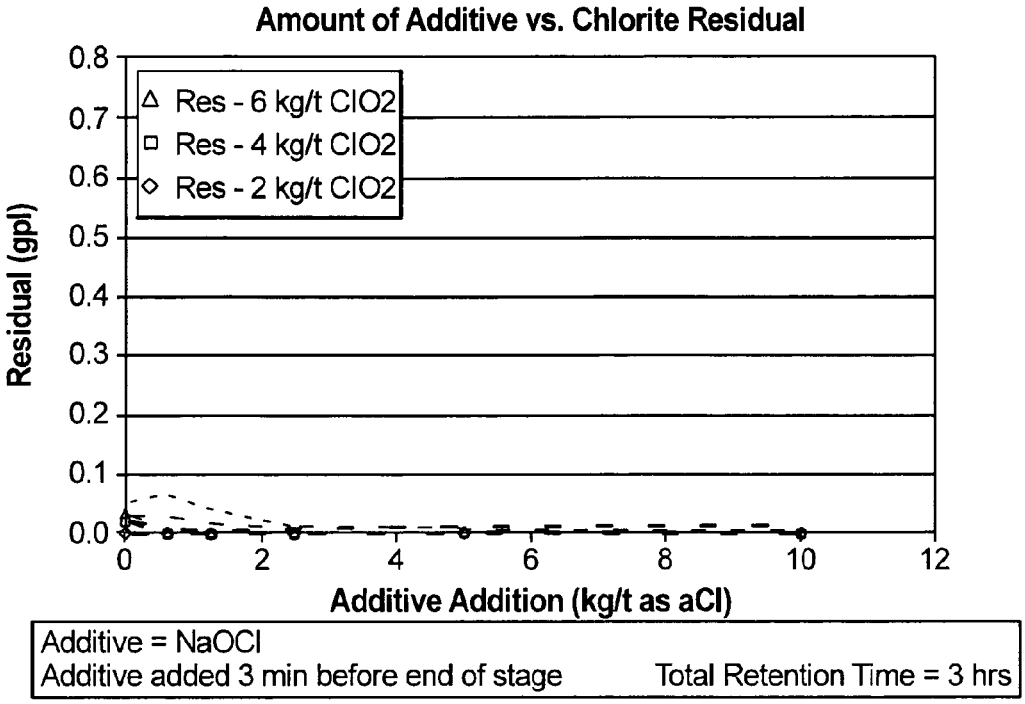
Figure 9D:
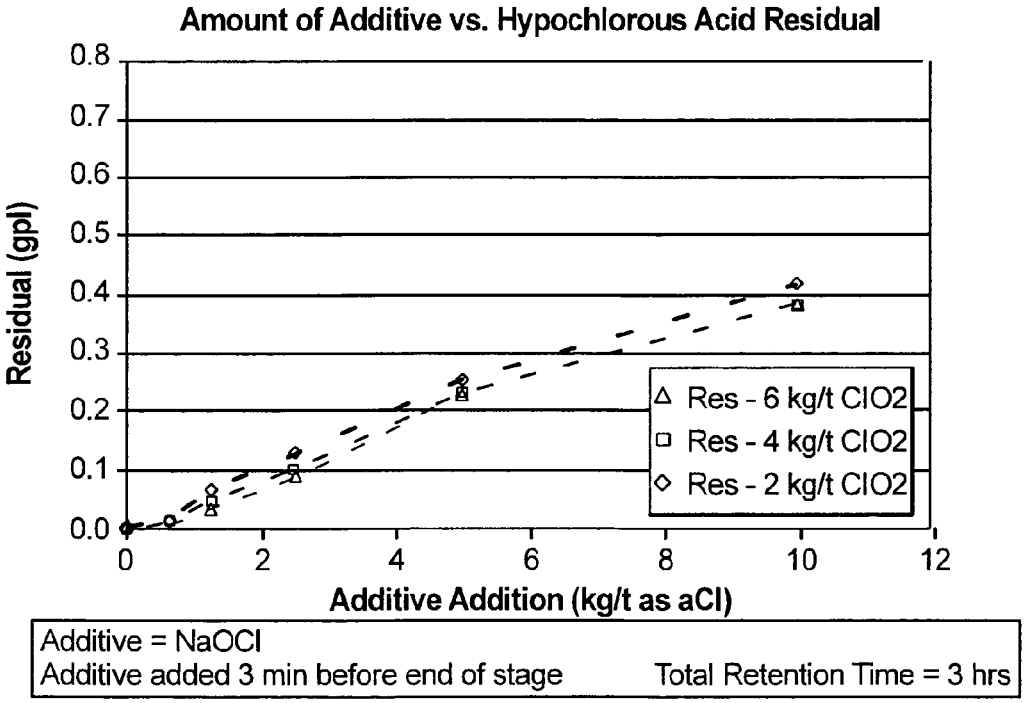

FIGS. 7 and 8 illustrate the effect of different amounts of additive on brightness.

FIGS. **9*a*-9*d*** illustrate the impact of different amounts of additives on residual species.

FIG. **10*a*** illustrates a comparison between final brightness and reverted brightness.

FIG. **10*b*** illustrates the effect of additive amount on brightness reversion.

FIGS. **11*a*-11*b*** illustrates the effect of pH and additive amount on reverted brightness.

FIGS. **12*a*-12*b*** illustrates the effect of additive on pulp viscosity.

Figure 13:
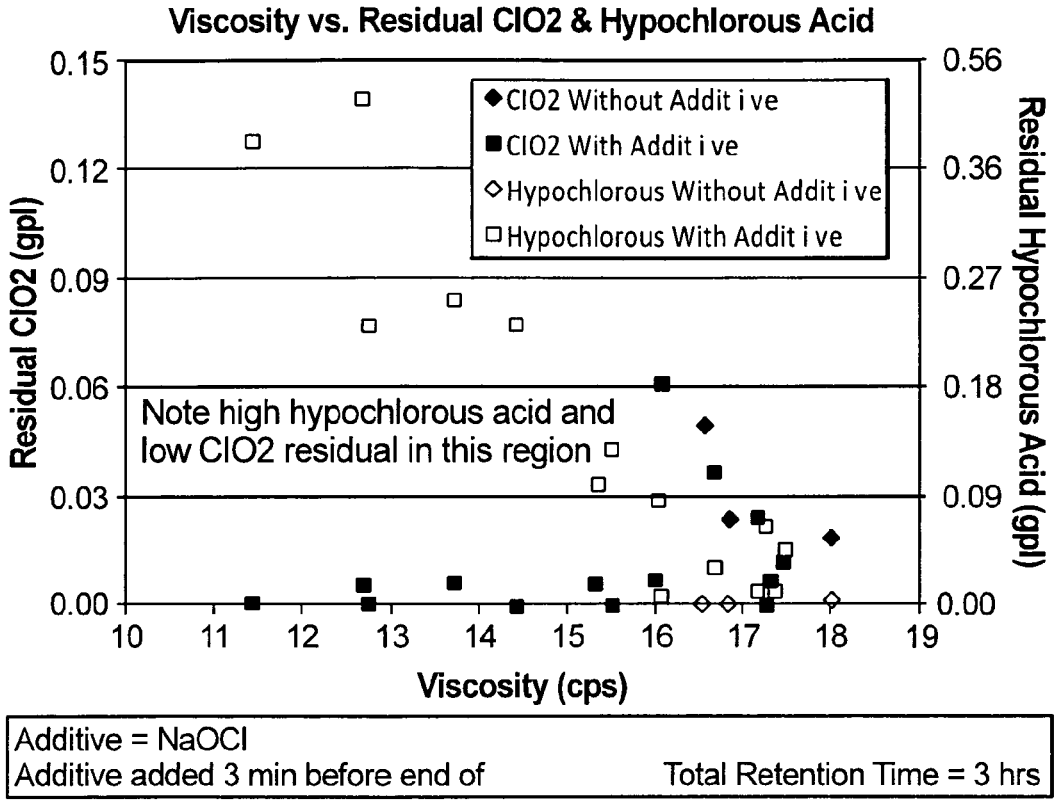

FIG. 13 illustrates the amount of residuals as a function of viscosity.

FIG. **14*a*** illustrates the effect of additive addition on viscosity.

FIG. **14*b*** illustrates the impact of different additive and residuals on viscosity.

DETAILED DESCRIPTION OF THE INVENTION

In an embodiment of the invention, the brightness additive is added near the end of a final D bleaching stage during the last 10% of bleaching stage, as a function of time, i.e., during the period beginning from about the last 10% of remaining time to the end of the bleaching stage. For example, the additive can be added during the last 3 minutes of a 30 minute bleaching stage. In another embodiment, the brightness additive can be added during the last 5% of the bleaching stage.

In an embodiment of the invention, the pH of the pulp slurry in the final D bleaching stage is in the range from about 3 to about 10 at the time the brightening additive is added to the slurry. In other embodiments, the pH of the slurry at the time of addition is in the range of about 4 to about 8, or about 4 to about 7.

In embodiments of the invention, the brightness additive is added to the final D bleaching stage in an amount in the range from about 1 to about 10 kg of additive per ton (1000 kg) of dry pulp, or about 2 to about 9 kg/ton, or about 3 to about 8 kg/ton, expressed as active chlorine ("aCl"). In embodiments, $ClO_2$ is added to the final D bleaching stage in an amount from about 1.5 to about 6 kg/ton (dry pulp), or about 2 to about 5 kg/ton, or about 2 to about 3 kg/ton, expressed as $ClO_2$.

In one embodiment, additional $ClO_2$ is added with the brightness additive in an amount to reduce viscosity drop of the pulp slurry in the bleaching stage. By adding with the additive is meant to include simultaneous addition or addition in relatively close proximity to each other, for example within about 30 seconds, or within about 20 seconds, of each other. In one embodiment, the additional $ClO_2$ and brightness additive are added simultaneously.

Experiments were conducted using an additive in the form of chlorine water or sodium hypochlorite to evaluate the performance of the additive on bleaching at different $ClO_2$ levels, additive levels, point of addition (time it was added) to the D2 stage, and effects on brightness reversion and pulp viscosity.

The pulp used in the experiments was softwood pulp taken from the D1 bleaching stage from a southern U.S. mill.

Evaluation of the Bleaching Additive Addition Point.

The impact on brightness was evaluated by adding the bleaching additive at different times throughout the D2 bleaching stage. The results are shown in FIGS. 1 and 2.

Figure 1:
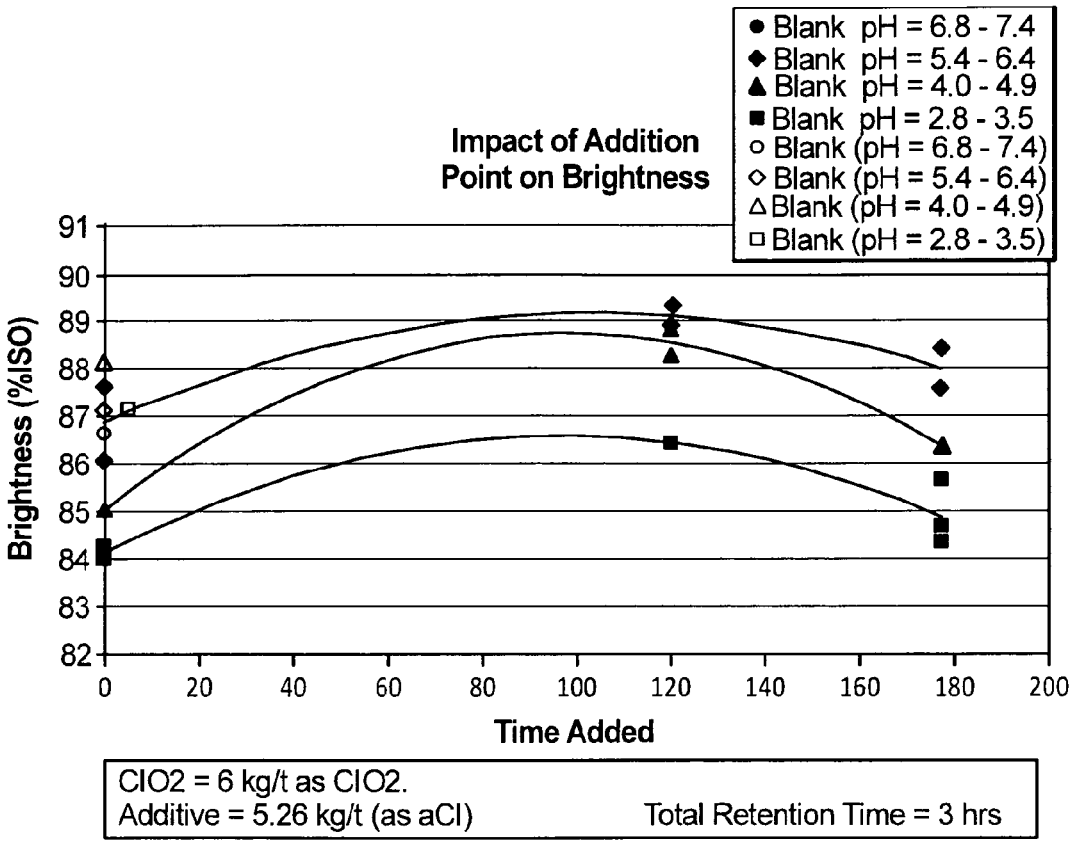
FIGS. 1-2 illustrate the effect of adding bleaching additives at different times during the D2 bleaching stage on brightness.
Figure 2:
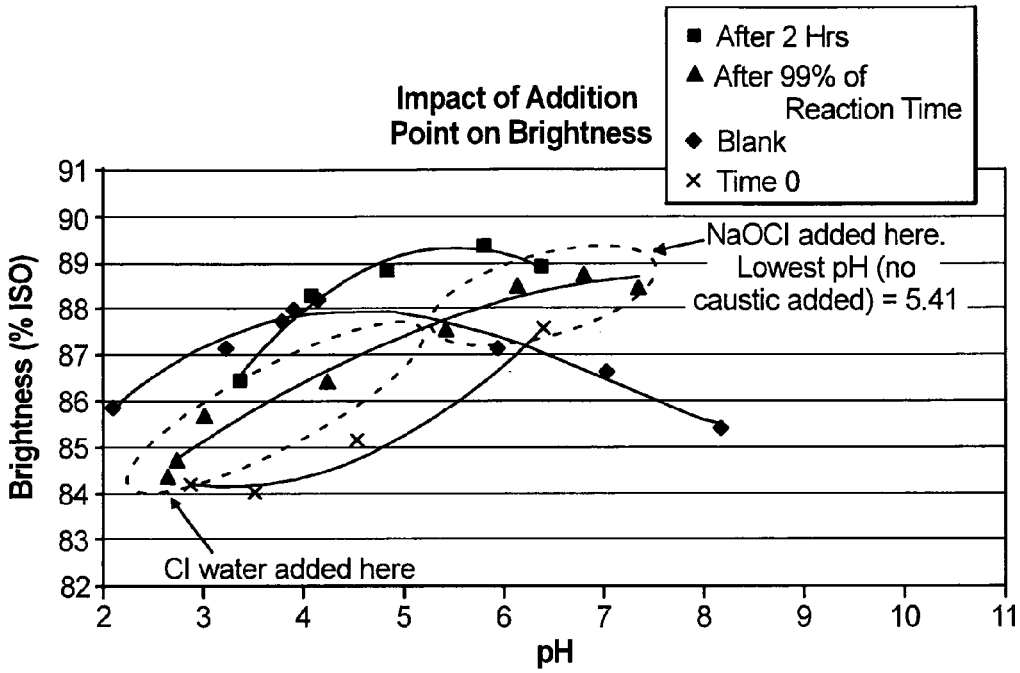

A review of FIGS. 1 and 2 reveals that the optimum addition point appears to be approximately 100 to 120 mins after $ClO_2$addition, however there was a lack of data between 0 and 120 mins to fully evaluate the entire range.

As the likely convenient addition points in an existing mill are at the beginning of the stage and at the end of the stage due to equipment and process constraints, these points will be of interest. It appears that the beginning of the stage is unsuitable since it resulted in lower brightness than the base case. The end of the stage (e.g., after 99% of reaction time) provided positive results, depending on the pH.

Evaluation of Different Additives and Amounts.

The effect of different additives and amounts on brightness as a function of pH was evaluated. The results are shown in FIG. 3.

Figure 3:
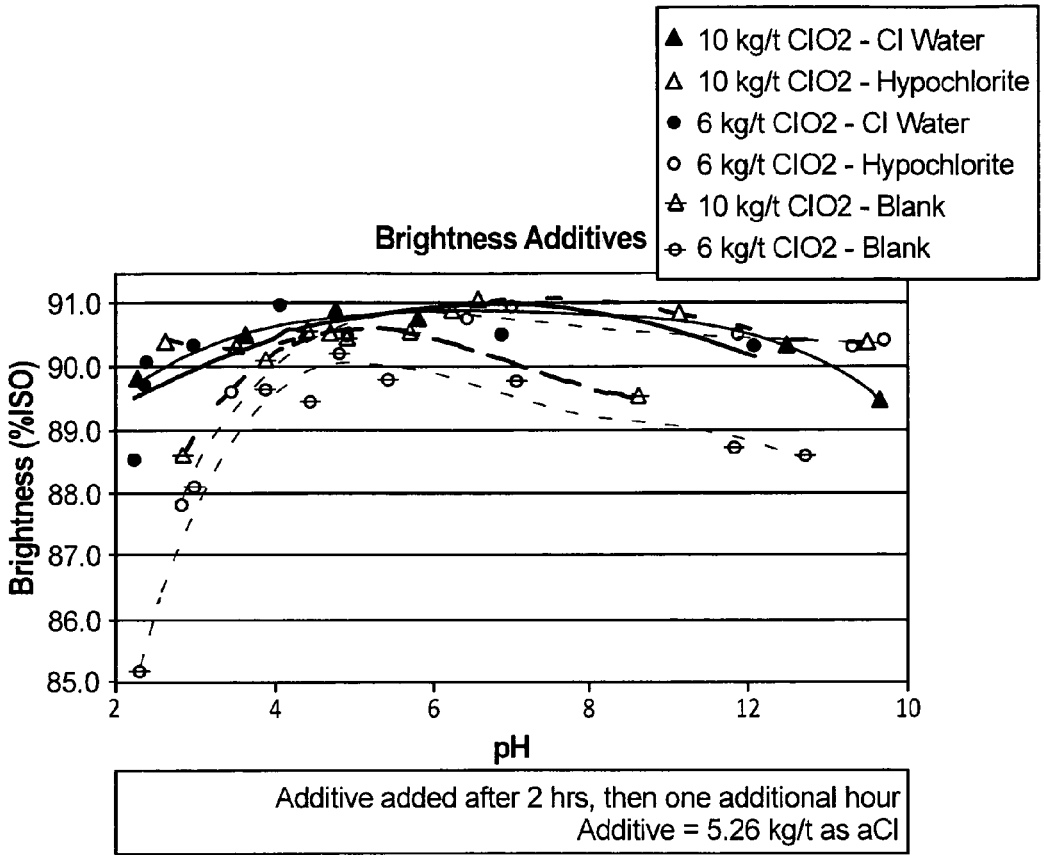
FIG. 3 illustrates the effect of different additives and amounts of additives on brightness as a function of pH.
Figure 4A:
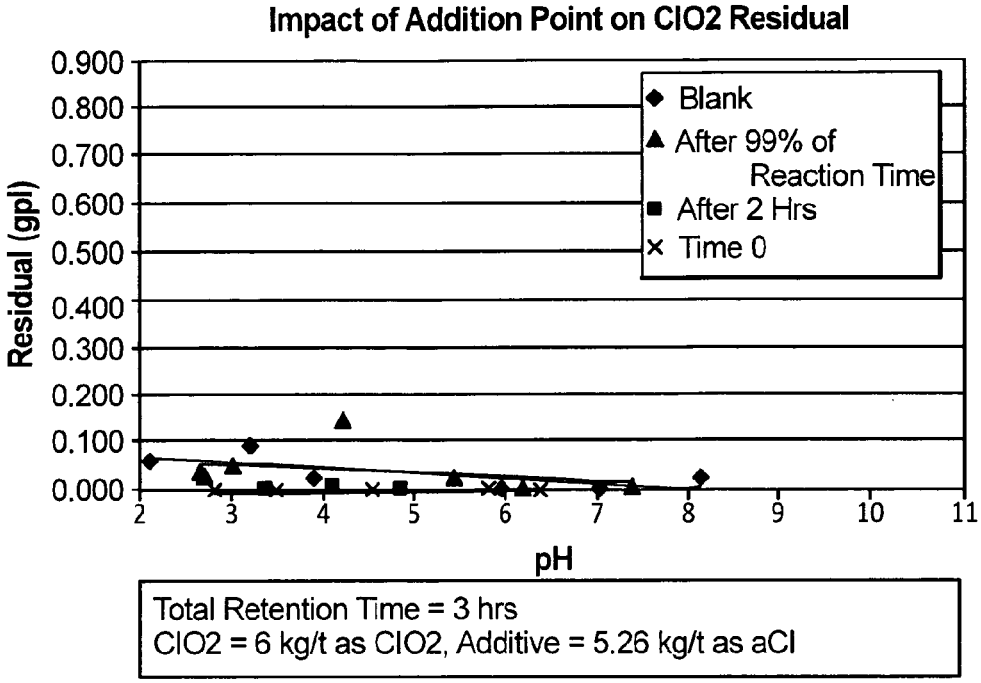
Figure 4B:
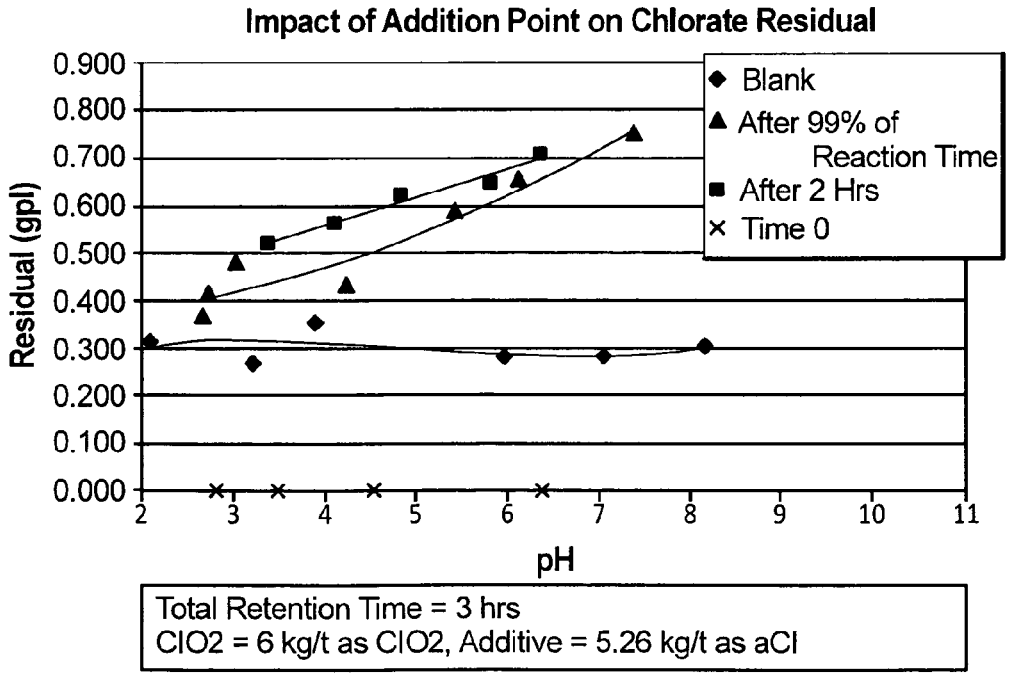
Figure 4C:
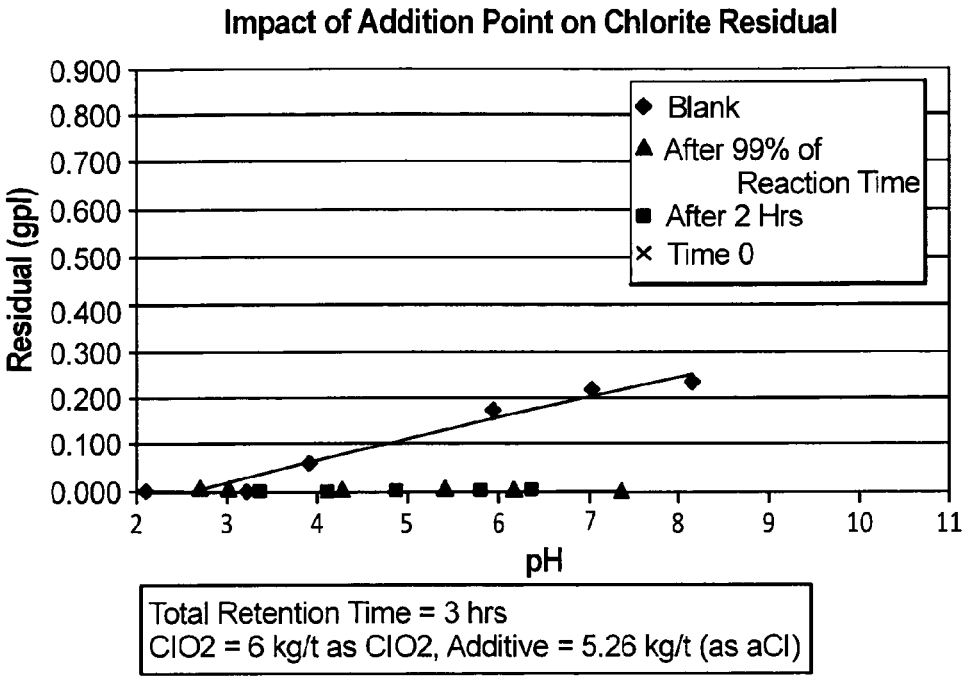
Figure 4D:
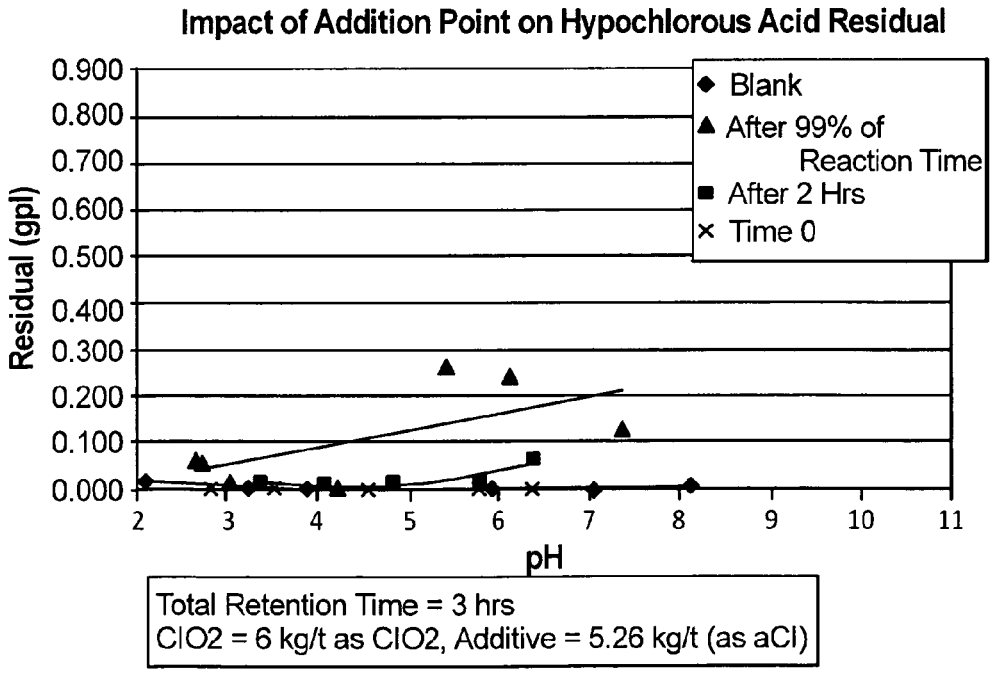

A review of FIG. 3 reveals that in some cases both NaOCl and Cl water can provide a broad, flat pH optimum across the entire pH range. However, it is believed that results can be affected by a combination of the amount of $ClO_2$ applied, type of additive, addition point, and maybe even wood species.

Evaluation of Residuals from Bleaching Step.

Detailed residual testing was performed to determine the amount of various species present at the end of the stage. The results are shown in FIG. 4.

A review of FIG. 4 reveals that the additive eliminates essentially all the chlorite residual that is otherwise left unreacted, while chlorate and hypochlorous acid residuals increase.

Evaluation of Addition Point on pH.

The impact of the addition point of the bleaching additive on final pH was evaluated. The results are shown in FIG. 5.

A review of FIG. 5 reveals that the choice of addition point has a large impact on final pH in the stage, even when the same amount of chemical is added. It is believed that this occurs because the reactions do not proceed to completion when the additive is added at the end of the stage. $ClO_2$ bleaching reactions typically cause pH to drop as they proceed. It is believed that the choice of the additive can affect the pH, since Cl water is acidic while NaOCl is basic.

Evaluation of Impact of Retention Time in Bleaching Step.

Older bleach plants usually run at much higher production rates than they were originally designed for. As a result, the towers are not able to provide as much retention time as desired and the mill can suffer from low brightness and/or high residual $ClO_2$. Accordingly, the effect of the additive on brightness as a function of retention time was evaluated. The results are shown in FIG. 6.

A review of FIG. 6 reveals that the additive can help compensate for the problem of short retention time since it provides a benefit even at very short retention times.

Evaluation of Different Amounts of Additives on Brightness.

The impact of different amounts of additive on brightness was also evaluated. Different amounts of the additive were added three minutes before the end of the D2 stage to approximate an addition point at the tower dilution. In order to keep the number of bleaches reasonable, a complete pH curve for every level of additive was not plotted. Instead, the optimum NaOH addition rate was assumed to be the same with the additive as it was for the blank. For example, at 6 kg/t of $ClO_2$, the optimum pH without the additive was 4.27. It took 2 kg/t of NaOH to obtain this pH, so 2 kg/t of NaOH was added to each of the runs with 6 kg/t of $ClO_2$ plus the additive. The results are shown in FIG. 7.

A review of FIG. 7 reveals that the additive gives good results at addition rates up to 10 kg/t aCl. As FIG. 7 shows, the additive gives a brightness boost as high as 3% ISO, which is very significant at the end of the bleach plant. Surprisingly, the brightness increase does not seem to level off at the highest addition rates examined.

The additive appears to work well at all $ClO_2$ addition rates studied. It also appears to give a larger brightness boost at low $ClO_2$ charges. This could be beneficial as a potential replacement of $ClO_2$ in mills that are not pushing their bleach plant to capacity limits.

FIG. 8 below replots the data from FIG. 7 in a slightly different manner that allows a more direct comparison of the different application rates.

Evaluation of Impact of Additive on Residuals.

The effect of using the additive on the amount of residuals of chemicals used in the bleaching process was also evaluated. The results are shown in FIG. 9.

A review of FIG. 9 reveals that the additive eliminates any $ClO_2$ and chlorite residuals, while increasing chlorate and hypochlorous acid residuals.

Evaluation of Impact of Additive on Brightness.

Sodium hypochlorite bleaching stages (H) are believed to cause fairly severe brightness reversion issues. A true H stage, however, runs at high pH (~10) and contains no $ClO_2$. However, sodium hypochlorite used according to the present invention is believed to be converted to hypochlorous acid due to the stage pH. It is further believed that the hypochlorous acid reacts with the pulp and should not cause severe reversion issues. Accordingly, reverted brightness was tested. The results are shown in FIGS. 10 and 11.

Figure 10A:
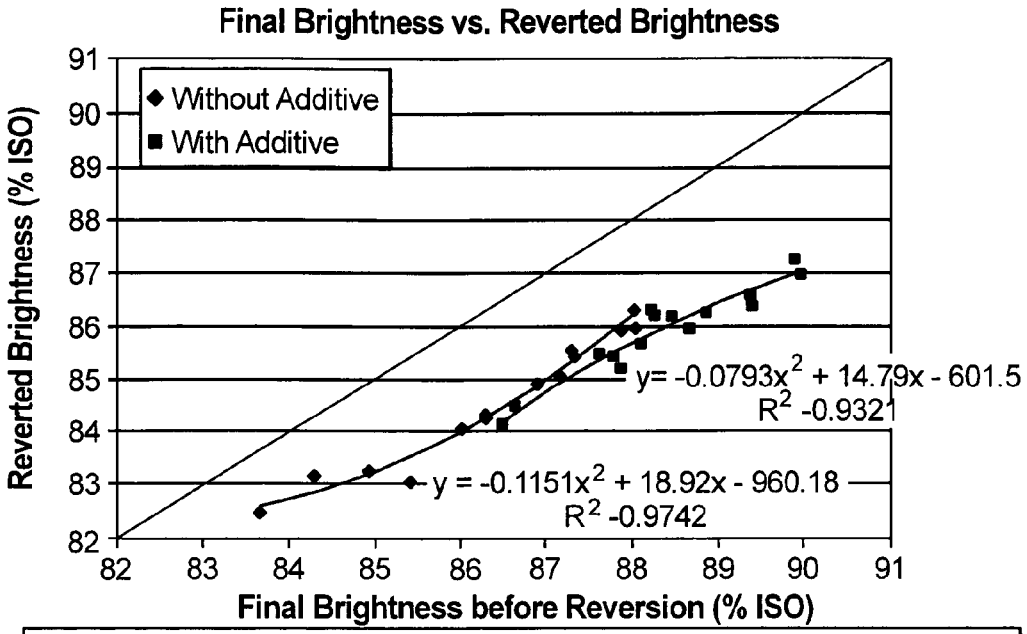
Figure 10B:
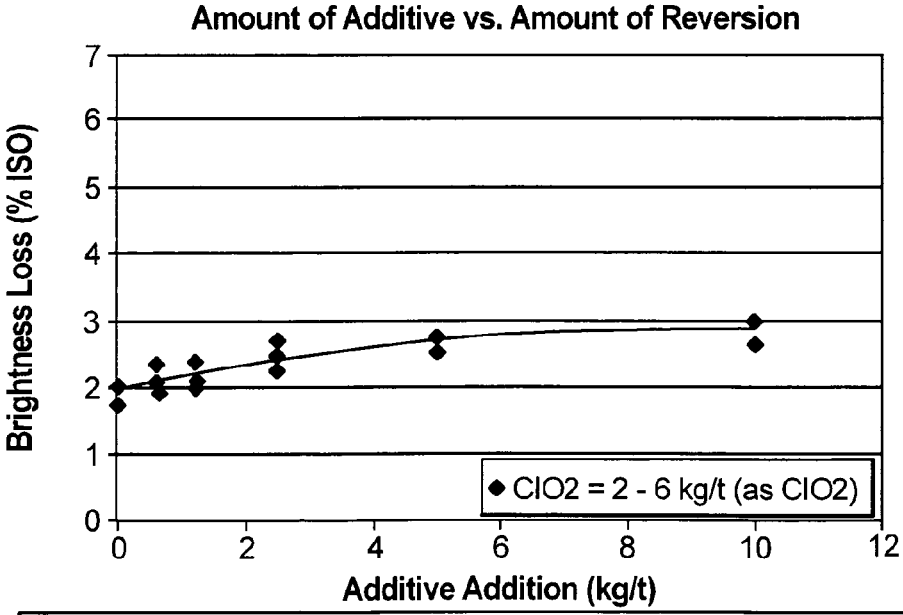
Figure 11A:
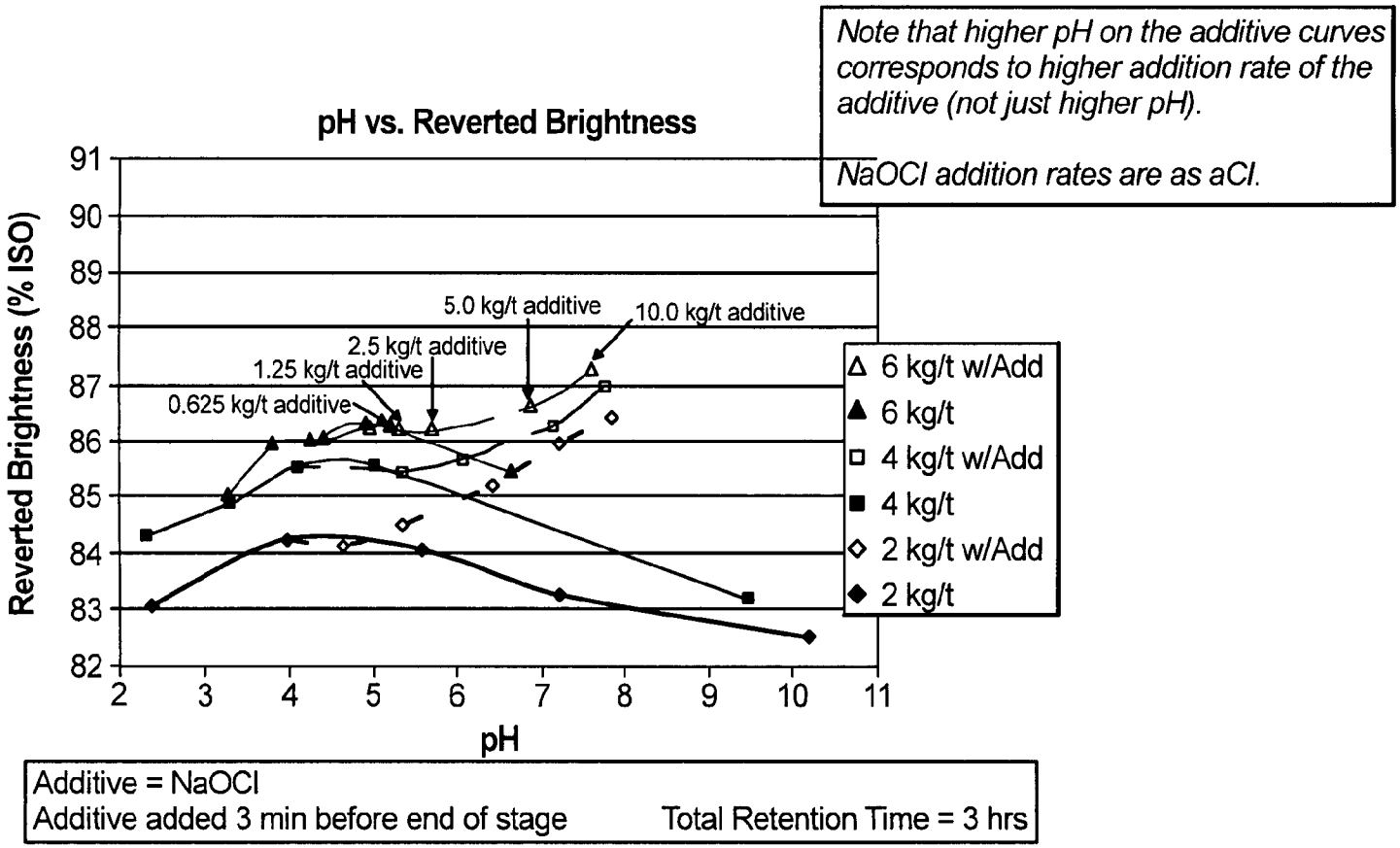
Figure 11B:
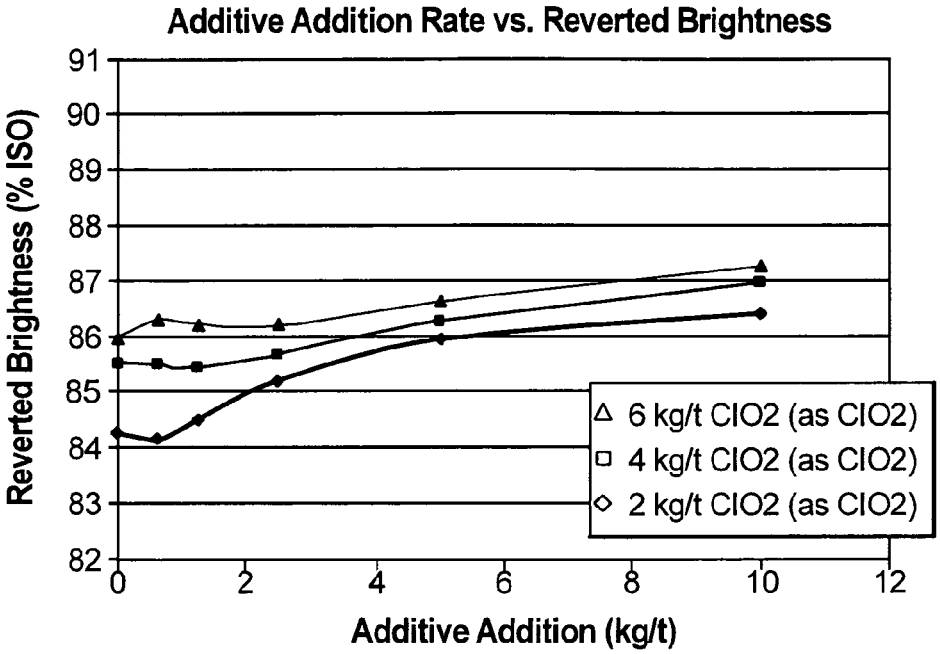

A review of FIGS. 10 and 11 reveals that reversion is slightly higher for pulps treated with the additive, but not excessive. Use of the additive still provides a significant benefit when the reverted brightness data is considered.

Evaluation of Impact of Additive on Viscosity.

The effect of the additive on pulp viscosity was also evaluated. The results are shown in FIG. 12.

Figure 12A:
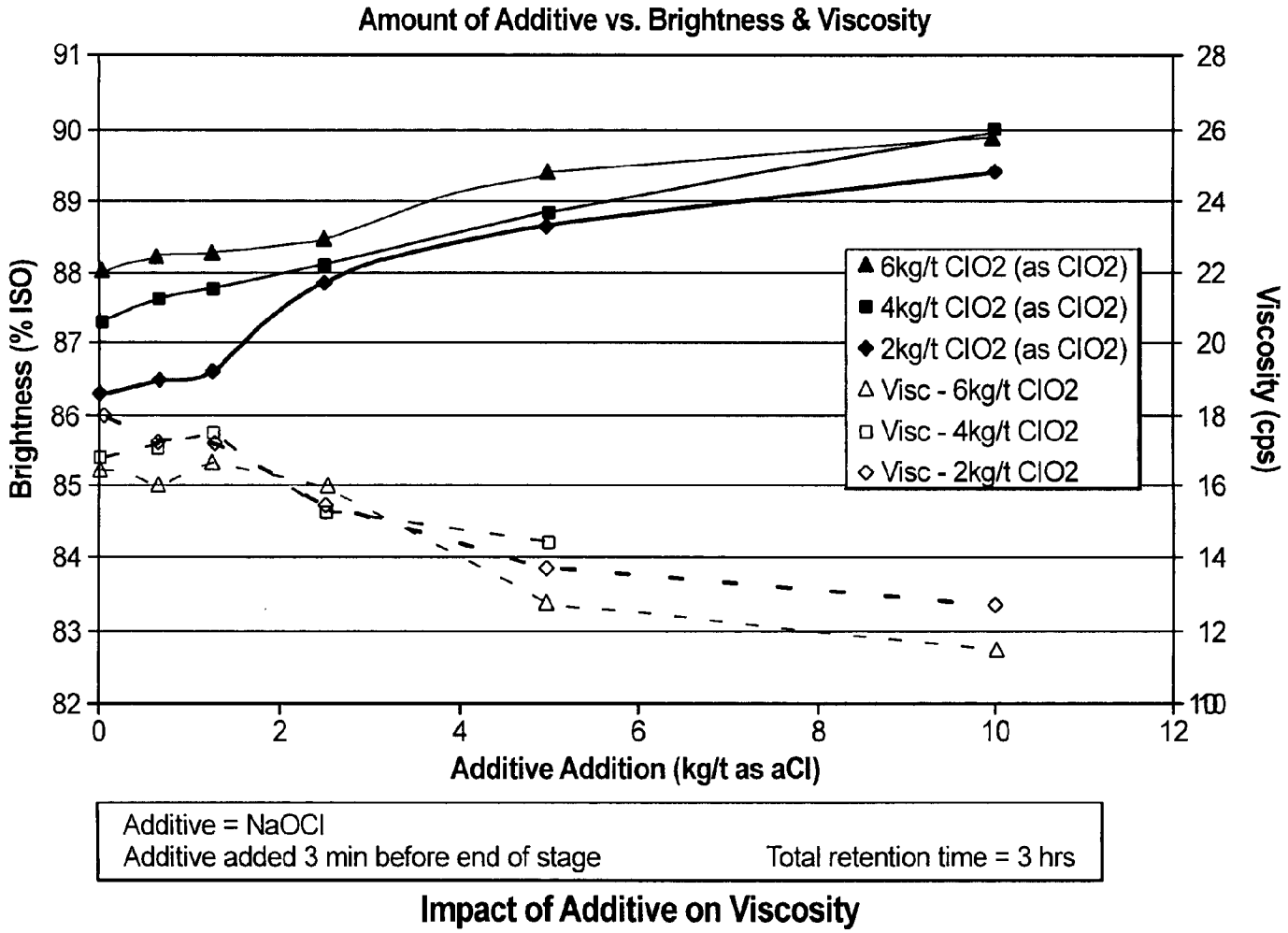
Figure 12B:
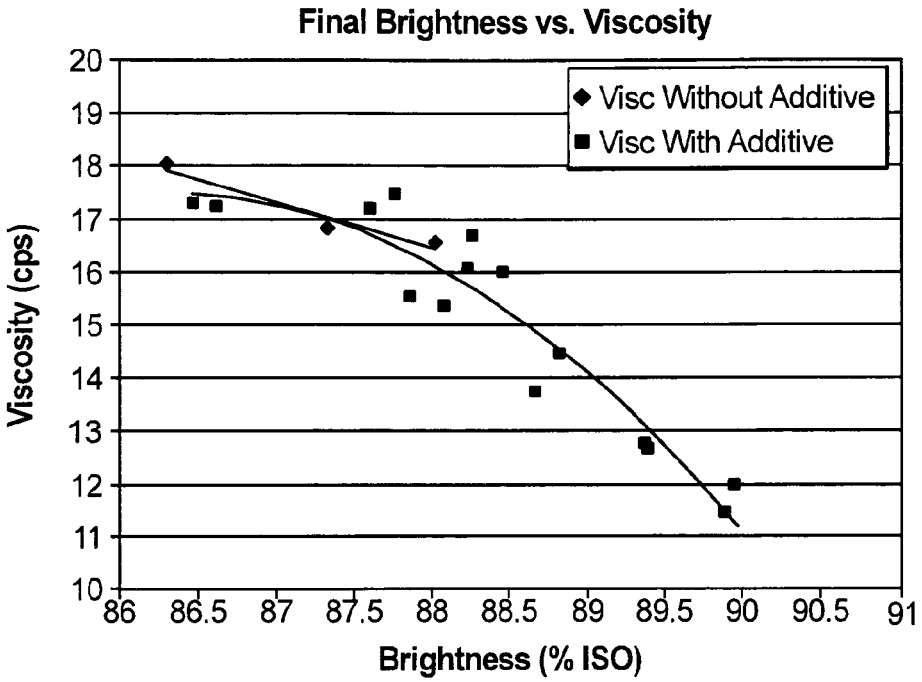

A review of FIG. 12 shows that viscosity drops as more additive is used. However, it appears that the viscosity drop is about the same for a given brightness gain whether $ClO_2$ is used by itself or with the additive. Also, the viscosity tests were done on brightness handsheets, which may reduce the absolute number by 10-15%, so some of the pulp may actually have a higher viscosity.

In order to further evaluate the reason for the viscosity decrease, additional tests were conducted to measure the residuals of the bleaching chemicals as a function of viscosity. The results are shown in FIGS. 13 and 14.

Figure 14A:
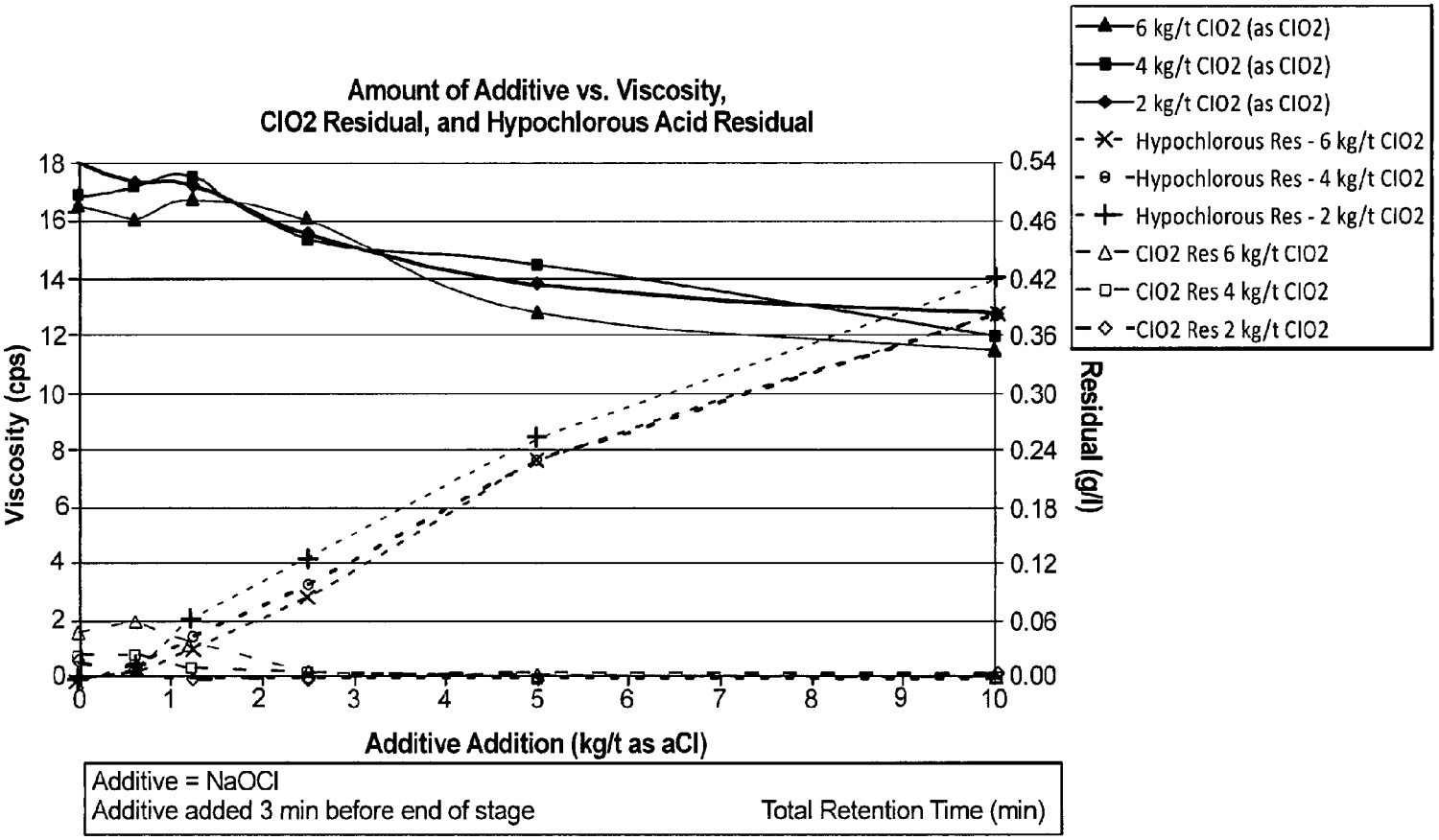
Figure 14B:
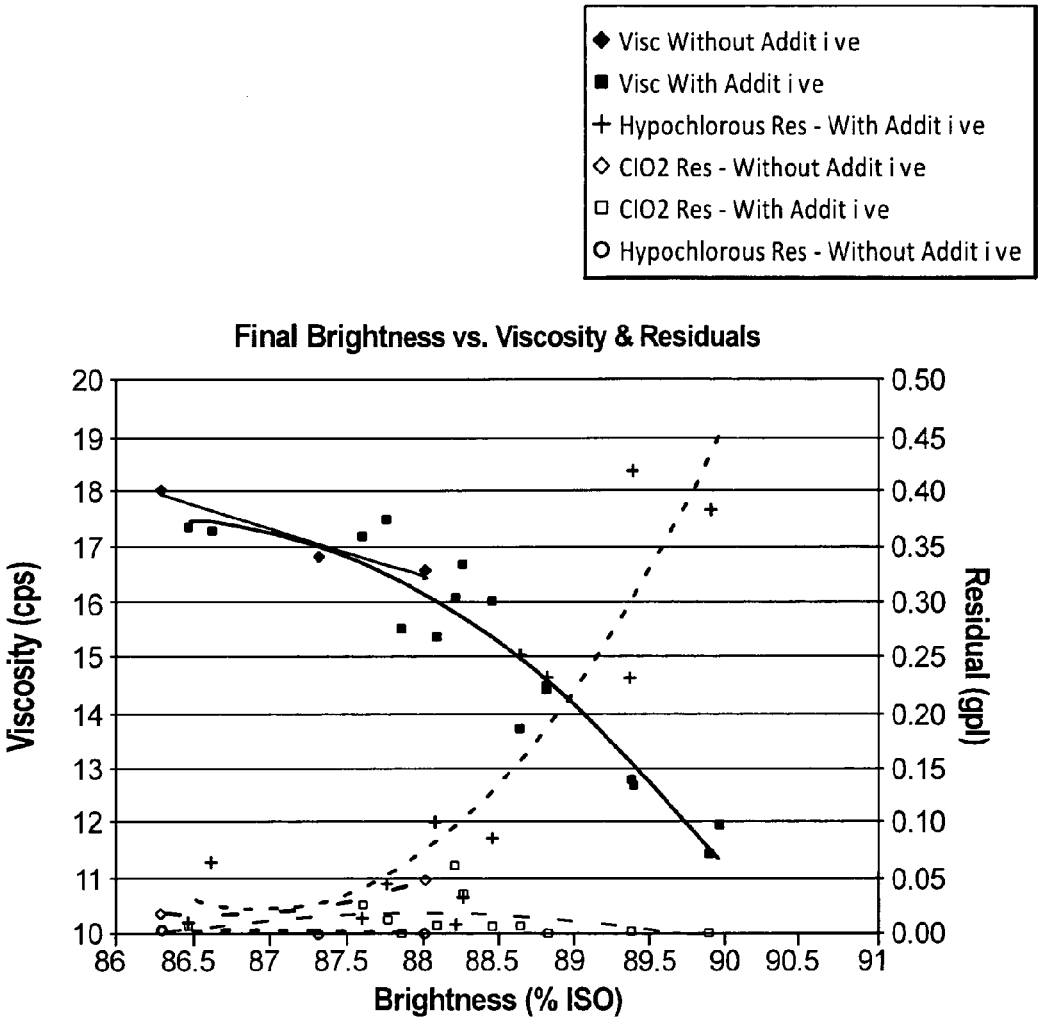

A review of FIGS. 13 and 14 reveals the it may be possible to overcome viscosity decrease. In that regard, FIGS. 13 and 14 show that lower viscosity pulp (<16 cps) seems to be associated with a combination of high hypochlorous acid residuals and low $ClO_2$ residuals. Therefore, it might be possible to minimize viscosity drop by adding an amount of $ClO_2$with the additive.

Based on the above experiments, the following observations can be made:

Good brightness results can be obtained by adding the additive after 120 minutes (with 180 minutes total retention time). An addition point of less than 5 minutes, e.g., 3 minutes, before the end of the stage works well. Putting the additive at the very beginning of the stage generally gives poor results.

Use of the additive resulted in a 3% ISO brightness increase, which is very significant at the end of the bleach plant. The additive gives good results up to and including application rates in amounts up to 10 kg/t aCl. Surprisingly, the brightness increase did not level off at the highest rate examined. Further, the additive works well at all $ClO_2$ application rates studied, including $ClO_2$ rates as low as 2 kg/t (as $ClO_2$).

For a given charge of total active chlorine, more additive and less $ClO_2$ provided higher brightness. The additive provides a consistent brightness increase even for very short (as low as 30 minutes) D2 stages, so it is believed that it can be used to compensate (at least partly) for stages with limited retention time.

Although use of the additive may cause brightness reversion to increase slightly, it still provides significant benefits even when judged on reverted brightness data. Reversion increases with increasing amount of additive. The highest increase in reversion was just under 1% ISO with 10 kg/t of the additive.

Although the additive sometimes gave lower brightness than the base case (without additive) at lower pH, this should not be a significant issue since addition points at the end of the stage had higher final pH than addition points at the beginning or 120 minutes into the stage.

Test revealed that viscosity decreases as more additive is used, but at lower additive charges, the viscosity change is about the same for a given brightness gain as it is when $ClO_2$ is used by itself.

What is claimed is:

1. A method for increasing brightness of pulp, said method comprising:

a) contacting a pulp slurry with chlorine dioxide in a final D ($ClO_2$) bleaching stage having a pre-selected bleaching time;

b) adding a brightening additive to said final D bleaching stage after 60% of the final D stage has been completed, in an amount in the range from about 0.625 to about 10 kg of additive/ton of dry pulp;

wherein said brightening additive is an inorganic compound chosen from hypochlorous acid, one or more precursor compounds that form hypochlorous acid in said final D bleaching stage, or a mixture thereof; and wherein the pH of the pulp slurry in the Final D bleaching stage at the time said brightening additive is added is in the range from about 3 to about 10.

2. The method according to claim 1, wherein the final D bleaching stage has a retention time from 30 to 180 minutes.

3. The method according to claim 1, wherein the brightening additive is added during the period of time beginning from about the last 10% of remaining time to the end of the bleaching stage.

4. The method according to claim 3, wherein the brightening additive is added during the period of time beginning from about the last 5% of remaining time to the end of the bleaching stage.

5. The method according to claim 4, wherein the brightening additive is added during the period of time with less than about 5 minutes remaining in the final D bleaching stage.

6. The method according to claim 5, wherein the brightening additive is one or more precursors compounds that form hypochlorus acid chosen from Cl, Cl water, sodium hypochlorite, or mixtures thereof.

7. The method according to claim 6, wherein the pH of the pulp slurry in the Final D bleaching stage at the time said brightening additive is added is in the range from about 3 to about 8.

8. The method according to claim 7, wherein the pH of the pulp slurry is in the range from about 4 to about 7.

9. The method according to claim 7, wherein the brightening additive is added in an amount in the range from about 1 to about 10 kg of additive/ton of dry pulp.

10. The method according to claim 7, wherein additional $ClO_2$ is added to said final D bleaching stage with said brightening additive in an amount sufficient to reduce viscosity drop of the pulp slurry.

11. The method according to claim 3, wherein the brightening additive is one or more precursors compounds that form hypochlorus acid chosen from Cl, Cl water, sodium hypochlorite, or mixtures thereof.

12. The method according to claim 11, wherein the pH of the pulp slurry in the Final D bleaching stage at the time said brightening additive is added is in the range from about 3 to about 8.

13. The method according to claim 12, wherein the pH of the pulp slurry is in the range from about 4 to about 7.

14. The method according to claim 12, wherein the brightening additive is added in an amount in the range from about 1 to about 10 kg of additive/ton of dry pulp.

15. The method according to claim 12, wherein additional $ClO_2$ is added to said final D bleaching stage with said brightening additive in an amount sufficient to reduce viscosity drop of the pulp slurry.

16. The method according to claim 1, wherein the brightening additive is one or more precursors compounds that form hypochlorus acid chosen from Cl, Cl water, sodium hypochlorite, or mixtures thereof.

17. The method according to claim 1, wherein the pH of the pulp slurry in the Final D bleaching stage at the time said brightening additive is added is in the range from about 3 to about 8.

18. The method according to claim 17, wherein the pH of the pulp slurry is in the range from about 4 to about 7.

19. The method according to claim 1, wherein the brightening additive is added in an amount in the range from about 1 to about 10 kg of additive/ton of dry pulp.

20. The method according to claim 1, wherein additional $ClO_2$ is added to said final D bleaching stage with said brightening additive in an amount sufficient to reduce viscosity drop of the pulp slurry.

* * * * *